US008303052B2

(12) United States Patent
Chen et al.

(10) Patent No.: US 8,303,052 B2
(45) Date of Patent: Nov. 6, 2012

(54) ELASTIC MECHANISM FOR A SLIDE ASSEMBLY

(75) Inventors: Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 210 days.

(21) Appl. No.: 12/756,394

(22) Filed: Apr. 8, 2010

(65) Prior Publication Data

US 2010/0259146 A1 Oct. 14, 2010

(30) Foreign Application Priority Data

Apr. 10, 2009 (TW) ..... 98112248 A

(51) Int. Cl.
*A47B 88/04* (2006.01)

(52) U.S. Cl. ..... 312/319.1; 312/334.47

(58) Field of Classification Search ..... 312/333, 312/334.1, 334.7, 334.8, 334.11, 334.44, 312/334.46, 334.47, 319.1; 384/18, 21, 22
See application file for complete search history.

(56) References Cited

U.S. PATENT DOCUMENTS 2,542,247 A * 2/1951 Gussack ..... 384/18
2,728,626 A * 12/1955 Gussack ..... 312/333
3,259,447 A * 7/1966 Deutsch ..... 312/334.46
3,371,968 A * 3/1968 Loake ..... 384/18
3,782,800 A * 1/1974 Remington et al. ..... 312/333
4,549,773 A * 10/1985 Papp et al. ..... 384/18
4,560,212 A * 12/1985 Papp et al. ..... 384/18
6,126,255 A * 10/2000 Yang ..... 312/334.46
6,749,276 B2 * 6/2004 Judge et al. ..... 312/334.47
7,413,269 B2 * 8/2008 Chen et al. ..... 312/333
7,857,403 B2 12/2010 Chen et al.

FOREIGN PATENT DOCUMENTS

DE 202006008564 U1 8/2006
GB 2235919 A 3/1991

OTHER PUBLICATIONS

Search Report From Corresponding European Patent Application Dated Aug. 11, 2010.

* cited by examiner

*Primary Examiner* — James O Hansen
*Assistant Examiner* — Matthew Ing
(74) *Attorney, Agent, or Firm* — Rosenberg, Klein & Lee

(57) ABSTRACT

An elastic mechanism for a slide assembly includes a first rail having an opening. The elastic mechanism includes a first elastic section, a second elastic section, and a connection section connected between the first and second elastic sections. The first elastic section, the second elastic section and the connection section define an elastic space. The first elastic section includes two first sidewalls and a first recess is defined between the first elastic section and the two first sidewalls. The second elastic section includes two second sidewalls and a second recess is defined between the second elastic section and the two second sidewalls. The elastic mechanism is connected to the opening of the first rail to provide an elastic force by the first and second recesses.

6 Claims, 4 Drawing Sheets

ELASTIC MECHANISM FOR A SLIDE ASSEMBLY

FIELD OF THE INVENTION

The present invention relates to an elastic mechanism, and more particularly, to an elastic mechanism for a slide assembly.

BACKGROUND OF THE INVENTION

Generally, a slide assembly is mainly used for furniture or a server rack, which provides the drawer of the furniture or the drawer of the server rack to be slidably pulled out or pushed in so as to conveniently organize objects and electronic appliances. There are different types of positioning functions for the purpose of safety operation, such as, the function to prevent the drawer from being pulled out improperly from the furniture or from the server rack, or the function that makes the drawer be positioned after being pulled out, or an anti-pinch device is provided to avoid from pinching the users' hand by the rails when releasing the positioning device, or sections of the rails move simultaneously. The slide assembly having these functions mostly includes multiple movable members to generate the relationship of movement therebetween and the movable members are cooperated with elastic mechanisms so as to achieve the purpose of rotation or linear movement, thereby allowing the mechanism to be operated smoothly.

For instance, U.S. Patent Publication No. 2008/0197758 to Mushan et al discloses an elastic mechanism for a movable member on rails. The elastic mechanism includes a bow-shaped elongated body which is made of elastic strings (page 2, lines 39-40). The elastic string has to be installed on a protrusion pressed on the rails and a section of the elastic string contacts against the protrusion so as to allow the elastic string to be placed on the rail. The elastic string tends to be dropped from the rail or the elasticity tends to fail due to vibration, hit or other severe ways of quality tests. Furthermore, the elastic string is placed on the rail and becomes a protrusion with certain thickness so that when the rail is too thin and the space above the rail is limited, the elastic string is difficult to be installed on the rail and needs to be improved.

SUMMARY OF THE INVENTION

The present invention intends to provide an elastic mechanism for a slide assembly and makes a movable member in the slide assembly to operate with stability and provides sufficient space for convenience of parts of the slide assembly.

The present invention relates to an elastic mechanism for a slide assembly and includes a first rail having an opening and a movable member connected to the first rail and located corresponding to the opening. The elastic mechanism includes a first elastic section, a second elastic section, and a connection section connected between the first and second elastic sections. The first elastic section, the second elastic section and the connection section define an elastic space. The first elastic section includes two first sidewalls and a first recess is defined between the first elastic section and the two first sidewalls. The first recess is engaged with a periphery of the opening of the first rail. The second elastic section includes two second sidewalls and a second recess is defined between the second elastic section and the two second sidewalls. The second recess is engaged with the movable member.

The first elastic section, the second elastic section and the connection section form a U-shaped elastic member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
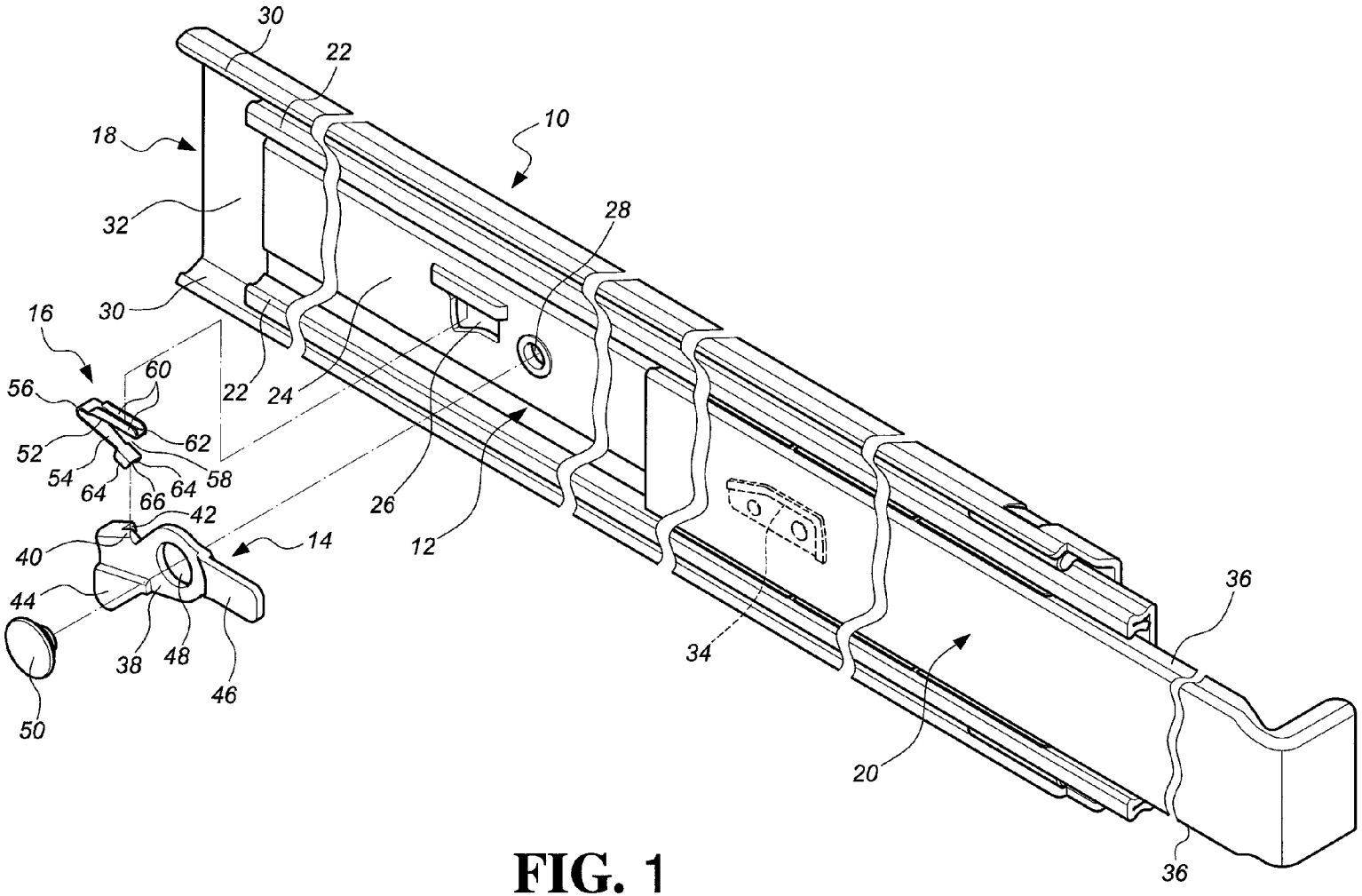
FIG. 1 is an exploded view to show the slide assembly and the elastic mechanism of the present invention.

Referring to FIG. 1, the slide assembly 10 of the present invention comprises at least one first rail 12, a movable member 14 connected to the first rail 12, and an elastic member 16 which forms an elastic mechanism and is connected to the first rail 12.

Figure 4:
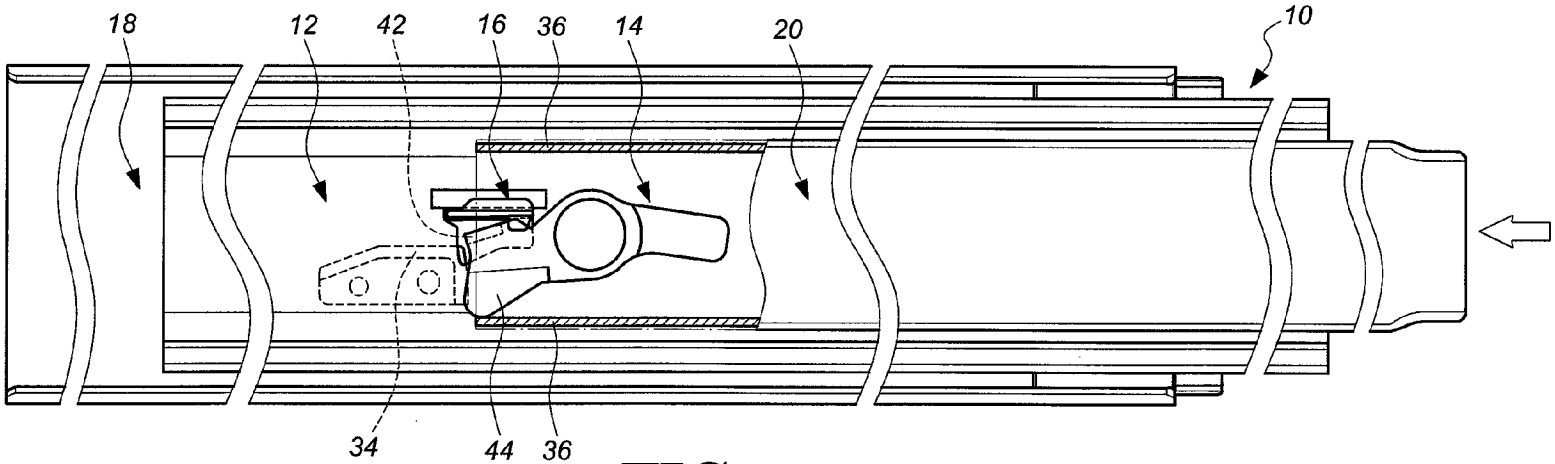
FIG. 4 shows that the third rail is retracted relative to the first rail.

The slide assembly 10 further comprises a second rail 18 to which the first rail 12 is slidably connected, and a third rail 20 slidably connected to the first rail 12. The first rail 12 includes two separated first flanges 22 and a first board 24 is vertically connected between the two first flanges 22. An opening 26 and a pivot hole 28 are defined through the first board 24 of the first rail 12. The second rail 18 includes two separated second flanges 30 and a second board 32 is vertically connected between the two second flanges 30. A position portion 34 is connected to the second board 32 of the second rail 18. The third rail 20 includes two separated third flanges 36 as shown in FIG. 4.

The movable member 14 includes a main portion 38 and a contact portion 40 extends from the main portion 38 and is located corresponding to the opening 26 of the first rail 12. A stop portion 42 extends from the contact portion 40 and is located longitudinally corresponding to the positioning portion 34 of the second rail 18. An operation portion 44 extends from the main portion 38 and is located longitudinally corresponding to one of the third flanges 36 of the third rail 20. A lever 46 extends from the main portion 38 and a pivot hole 48 is located between the contact portion 40 and the lever 46. In this embodiment, the movable member 14 is pivotably connected to the pivot hole 28 of the first rail 12 by a rivet 50 so that the movable member 14 is pivotably connected to the first rail 12.

The elastic member 16 which forms the elastic mechanism is substantially a U-shaped member and includes a first elastic section 52, a second elastic section 54 and a connection section 56 connected between the first and second elastic sections 52, 54. The first elastic section 52, the second elastic section 54 and the connection section 56 form the U-shaped elastic member 16. The first elastic section 52, the second elastic section 54 and the connection section 56 define an elastic space 58. The first elastic section 52 includes two first sidewalls 60 and a first recess 62 is defined between the first elastic section 52 and the two first sidewalls 60. The first recess 62 is engaged with a periphery of the opening 26 or a portion of the cross section of the opening 26 of the first rail 12. The second elastic section 54 includes two second sidewalls 64 and a second recess 66 is defined between the second elastic section 54 and the two second sidewalls 66. The second recess 66 is engaged with the movable member 14 or a portion of the cross section of the movable member 14.

Figure 2:
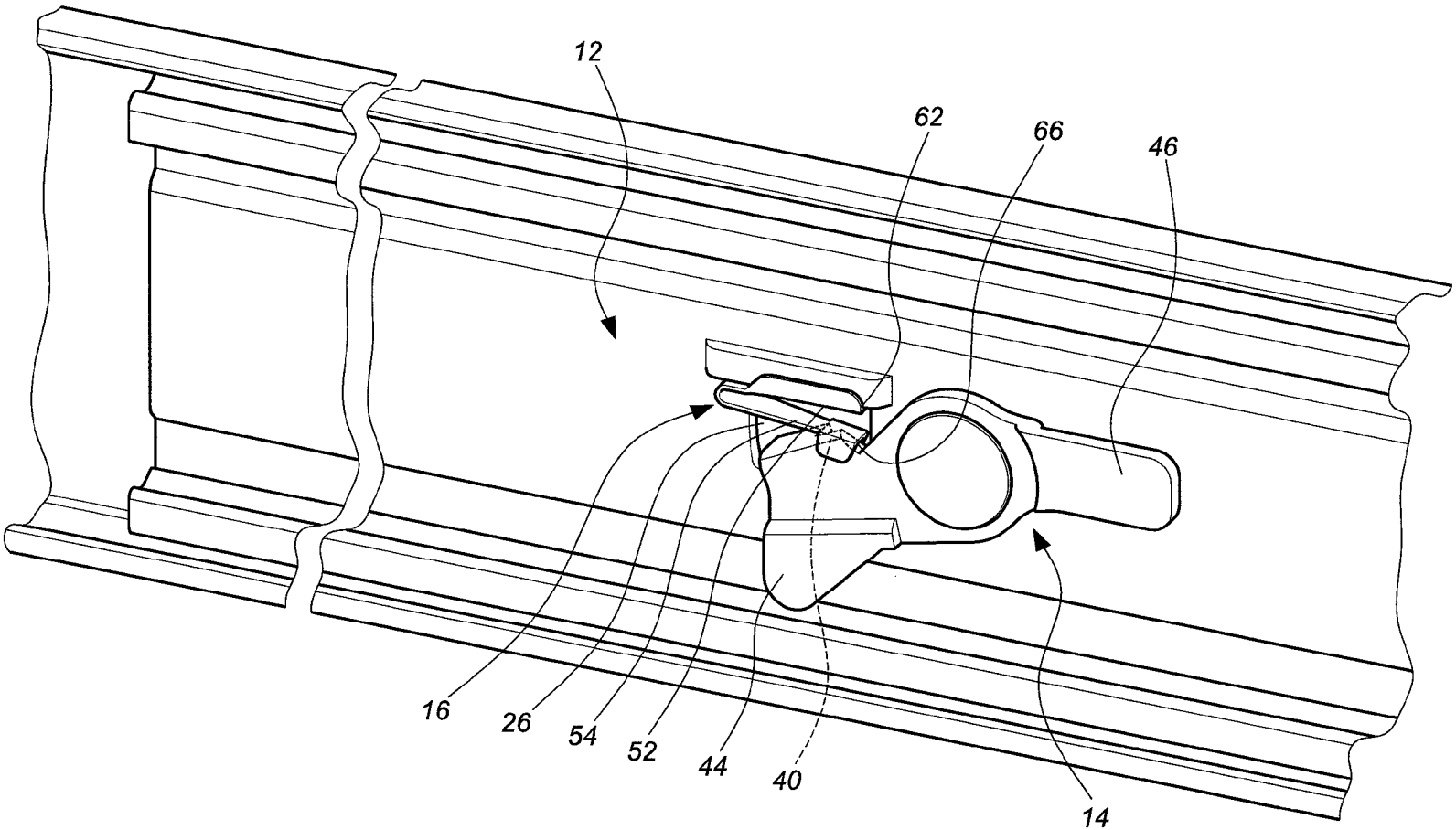
FIG. 2 is a perspective view to show that the elastic mechanism of the present invention is connected to the slide assembly.

FIG. 2 shows that the first recess 62 of the first elastic section 52 of the elastic member 16 is engaged with the opening 26 of the first rail 12, and the second recess 66 of the second elastic section 54 of the elastic member 16 is engaged with the contact portion 40 of the movable member 14, so that the movable member 14 is firmly positioned by the biasing force form the elastic member 16 and kept at the temporary and stable position. When in operation, the lever 46 of the movable member 14 is operated by the user to lift the contact portion 40 of the movable member 14 to push the elastic member 16. Alternatively, the operation portion 44 of the movable member 14 is pushed by a force directly so as to lift the contact portion 40 of the movable member 14 to push the elastic member 16.

Figure 3:
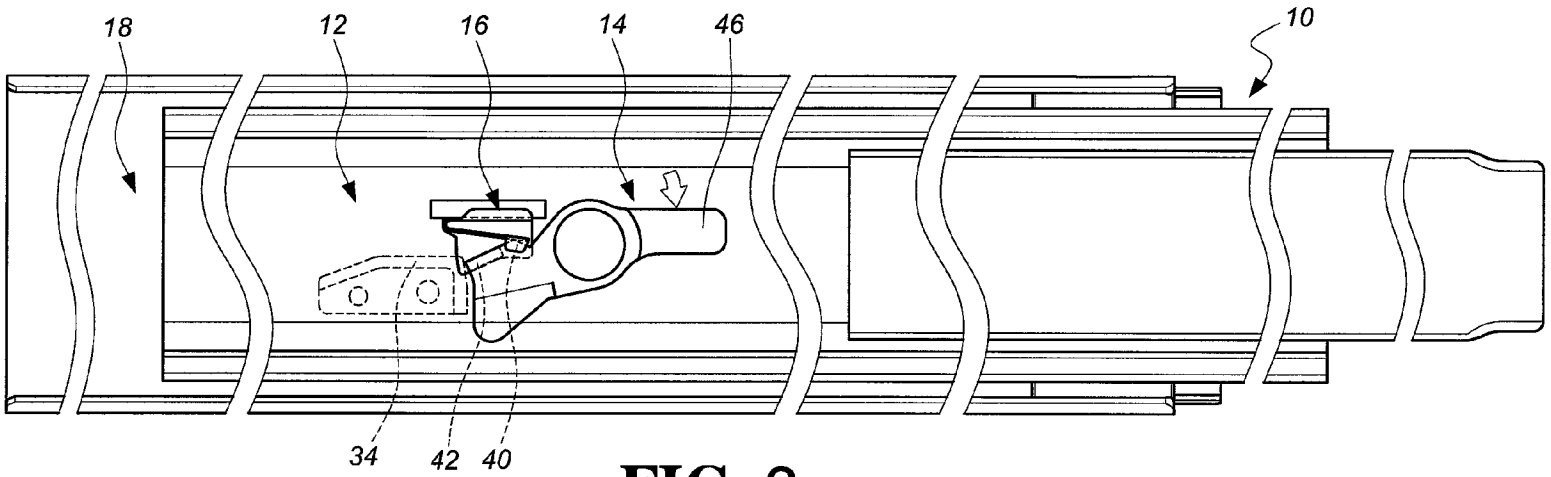
FIG. 3 shows the first and second rails are positioned relative to each other by the cooperation of the elastic mechanism and the movable member.

FIG. 3 shows that the slide assembly 10 is extended to a pre-set position and the stop portion 42 of the movable member 14 is in contact with the position portion 34 on the second rail 18, so that the first and second rails 12, 18 are positioned relative to each other.

When releasing the positioning between the first and second rails 12, 18, and retracting the first rail 12 relative to the second rail 18, the lever 46 of the movable member 14 is manually operated to press the elastic member 16 by the contact portion 40 of the movable member 14. By this way, the stop portion 42 of the movable member 14 is disengaged from the positioning portion 34 of the second rail 18.

Alternatively, as shown in FIG. 4, the third rail 20 is slidably retracted relative to the first rail 12, the third flange 36 of the third rail 20 directly pushes the operation portion 44 of the movable member 14 to disengage the stop portion 42 of the movable member 14 from the positioning portion 34 of the second rail 18. By this way, both the first and third rails 12, 20 are retracted relative to the second rail 18.

Therefore, the positioning between the first and second rails 12, 18 can be released by manually operation of the lever 46 of the movable member 14 or by retracting the third rail 20 relative to the first rail 12.

Figure 5:
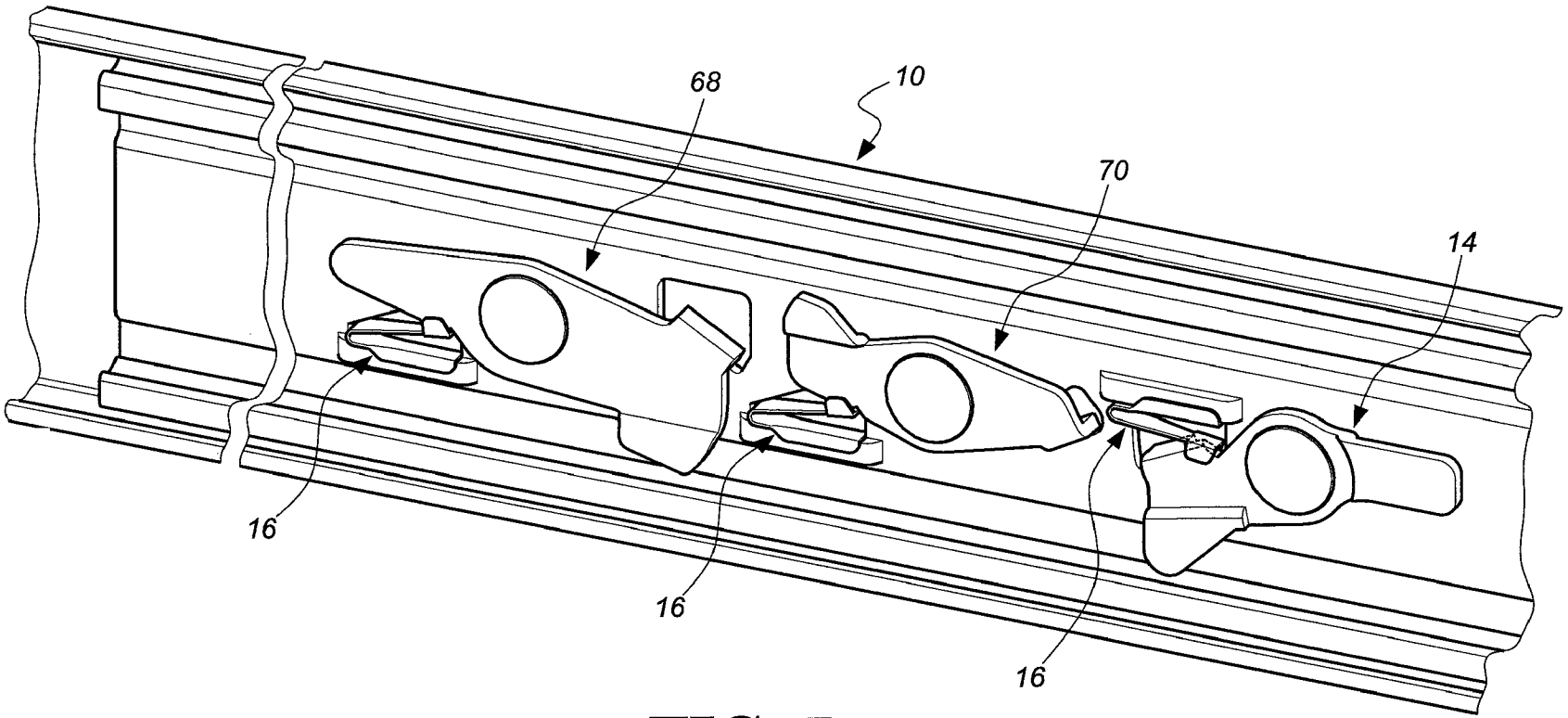
FIG. 5 shows that the elastic mechanism of the present invention is cooperated with different types of movable members connected to the slide assembly.

FIG. 5 shows that the elastic member 16 forming the elastic mechanism of the present invention can be used to cooperate with different types of movable members on the slide assembly 10. The drawing shows the movable member 14 described above and other types of movable members 68, 70 which can be individually installed and not limited to the movable members that are rotatable. The movable members can also be moved linearly. The linear or rotatable movement is known to the persons in the art and will not be described further.

While we have shown and described the embodiment in accordance with the present invention, it should be clear to those skilled in the art that further embodiments may be made without departing from the scope of the present invention.

What is claimed is:

1. An elastic mechanism for a slide assembly which comprises at least one first rail having an opening, a movable member connected to the first rail and located corresponding to the opening, the elastic mechanism comprising:

a first elastic section;

a second elastic section, and a connection section connected between the first and second elastic sections, the first elastic section, the second elastic section and the connection section defining an elastic space, the first elastic section including two first sidewalls, said two first sidewalls defining a first recess therebetween, the first recess is engaged with a periphery of the opening of the first rail, the second elastic section including two second sidewalls, said two second sidewalls defining a second recess therebetween, the second recess is engaged with the movable member, said second elastic section being in contact with and displaceable responsive to a rotational displacement of said movable member.

2. The elastic mechanism as claimed in claim 1, wherein the first elastic section, the second elastic section and the connection section form a U-shaped elastic member.

3. A slide assembly comprising: a first rail having two separated first flanges, a first board vertically connected between the two first flanges, an opening defined through the first board of the first rail;

a second rail slidably connected to the first rail and having two separated second flanges, a second board vertically connected between the two second flanges;

a third rail slidably connected to the first rail and having two separated third flanges;

an elastic mechanism comprising a first elastic section, a second elastic section and a connection section connected between the first and second elastic sections, the first elastic section, the second elastic section and the connection section defining an elastic space, the first elastic section including two first sidewall, said two first sidewalls defining a first recess therebetween, the first recess is engaged with a periphery of the opening of the first rail, and a movable member installed between the first rail and the second elastic section of the elastic mechanism, the movable member comprising an operation portion which is located longitudinally and corresponding to one of the two third flanges of the third rail;

wherein when the third rail is retracted relative to the first rail, the movable member is moved by the third flange of the third rail pushing the operation portion.

4. The slide assembly as claimed in claim 3, wherein the elastic mechanism is a U-shaped mechanism.

5. The slide assembly as claimed in claim 3, wherein the second elastic section includes two second sidewalls, said two second sidewalls defining a second recess therebetween, the second recess is engaged with the movable member.

6. The slide assembly as claimed in claim 3, wherein the movable member includes a lever for operation by users to press the elastic mechanism.

* * * * *